US007740243B1

(12) United States Patent
Kean

(10) Patent No.: US 7,740,243 B1
(45) Date of Patent: Jun. 22, 2010

(54) LOTTERY POKER GAME

(76) Inventor: Brian Kean, 938 Longview Rd., Missouri Valley, IA (US) 51555

( * ) Notice: Subject to any disclaimer, the term of this patent is extended or adjusted under 35 U.S.C. 154(b) by 357 days.

(21) Appl. No.: 11/811,259

(22) Filed: Jun. 8, 2007

Related U.S. Application Data

(60) Provisional application No. 60/812,481, filed on Jun. 9, 2006.

(51) Int. Cl.
*A63B 71/00* (2006.01)

(52) U.S. Cl. ..... 273/139

(58) Field of Classification Search ..... None
See application file for complete search history.

(56) References Cited

U.S. PATENT DOCUMENTS

| | | | | |
|---|---|---|---|---|
| 5,393,057 | A * | 2/1995 | Marnell, II | 463/13 |
| 6,210,276 | B1 * | 4/2001 | Mullins | 463/27 |
| 6,220,961 | B1 * | 4/2001 | Keane et al. | 463/16 |
| 6,780,104 | B2 * | 8/2004 | Fox | 463/13 |
| 6,783,456 | B2 * | 8/2004 | White | 463/18 |
| 6,811,484 | B2 * | 11/2004 | Katz et al. | 463/17 |
| 7,494,410 | B2 * | 2/2009 | Romik | 463/13 |
| 7,500,912 | B2 * | 3/2009 | Owen | 463/13 |
| 7,503,846 | B2 * | 3/2009 | Owen | 463/13 |
| 2001/0019193 | A1 * | 9/2001 | Gumina | 273/139 |

* cited by examiner

*Primary Examiner*—Gene Kim
*Assistant Examiner*—Dolores Collins
(74) *Attorney, Agent, or Firm*—Suiter Swantz pc llo

(57) ABSTRACT

The present invention is directed to a poker lottery game, including a poker lottery ticket, which leverages commonly known gaming rules and introduces multiple levels of game play. The ticket may be generated by a terminal located at, but separate from, a point of sale location. The ticket includes one or more lottery numbers along with card values corresponding to the lottery numbers. The ticket may be generated with one or more levels of play disabled or with one or more of the lottery numbers/card values concealed. The disabled levels may be enabled, the one or more of the lottery numbers/card values may be revealed, or the play value of one or more levels may be increased by registering the ticket, as part of a loyalty rewards program or web loyalty program, by purchase, by disabling one or more enabled game play levels or by combining multiple poker lottery tickets.

24 Claims, 9 Drawing Sheets

300

Lottery Ball ⇨ Card Translation

| | | | |
|---|---|---|---|
| 1 = A ♣ | 11 = A ♢ | 21 = A ♡ | 31 = A ♤ |
| 2 = 2 ♣ | 12 = 2 ♢ | 22 = 2 ♡ | 32 = 2 ♤ |
| 3 = 3 ♣ | 13 = 3 ♢ | 23 = 3 ♡ | 33 = 3 ♤ |
| 4 = 4 ♣ | 14 = 4 ♢ | 24 = 4 ♡ | 34 = 4 ♤ |
| 5 = 5 ♣ | 15 = 5 ♢ | 25 = 5 ♡ | 35 = 5 ♤ |
| 6 = 6 ♣ | 16 = 6 ♢ | 26 = 6 ♡ | 36 = 6 ♤ |
| 7 = 7 ♣ | 17 = 7 ♢ | 27 = 7 ♡ | 37 = 7 ♤ |
| 8 = 8 ♣ | 18 = 8 ♢ | 28 = 8 ♡ | 38 = 8 ♤ |
| 9 = 9 ♣ | 19 = 9 ♢ | 29 = 9 ♡ | 39 = 9 ♤ |
| 10 = 10 ♣ | 20 = 10 ♢ | 30 = 10 ♡ | 40 = 10 ♤ |
| 41 = J ♣ | 44 = J ♢ | 47 = J ♡ | 50 = J ♤ |
| 42 = Q ♣ | 45 = Q ♢ | 48 = Q ♡ | 51 = Q ♤ |
| 43 = K ♣ | 46 = K ♢ | 49 = K ♡ | 52 = K ♤ |

53 = JOKER 54 = JOKER 55 = JOKER

*FIG. 3*

LOTTERY POKER GAME

CROSS-REFERENCE TO RELATED APPLICATIONS

The present application claims the benefit under 35 U.S.C. §119(e) of U.S. Provisional Application Ser. No. 60/812,481, filed Jun. 9, 2006. Said U.S. Provisional Application Ser. No. 60/812,481 is herein incorporated by reference in its entirety.

FIELD OF THE INVENTION

The present invention relates generally to games and more particularly to a lottery poker game.

BACKGROUND OF THE INVENTION

In today's gaming environment, there is a constant drive to develop new gaming features or gaming techniques to enhance participation, aid in marketing, and further engage consumers. Many such efforts to create new games require players to learn new rules or embrace new, unfamiliar playing experiences. New games may be somewhat successful with established gaming players, but have limited success in drawing in new populations of gamers. Games which draw new gaming players typically include gaming elements that are easily understandable, or commonly understood, and well accepted and prized in common culture. Attempting to draw in new gaming players utilizing new, unknown games, experiences limited success at best and shifts previously engaged gaming players from already established games. Further, traditional distribution and play of lottery games is not well suited to aiding marketing of additional products and services. Traditional lottery games are typically limited to a single level of non-interactive game play with little ability to aid in marketing additional products and services or further interact with the consumer.

Attempts have been made to broaden lottery gaming, but with limited success. These attempts included the "UNO" lottery game in the state of Nebraska and the Iowa Touchplay system. The "UNO" lottery game in the state of Nebraska is a scratch-off ticket format game roughly based on the UNO® card game. The "UNO" lottery game fails because few people past the age of adolescence remember the rules of the UNO® card game or have a great appreciation for the game. Further, the "UNO" lottery game does not offer the full experience of the UNO® card game, offering merely a "one time" gaming experience. There is little popular appeal to the "UNO" lottery game and it requires too much mental engagement to learn the new set of rules for play. The Iowa Touchplay system presented a slot machine type of play whereby the source of the slot outcome was derived from virtual scratch-off playing tickets. The Touchplay system encountered serious legislative difficulties and was consequently shut down due to the perception that the prevalence of unrestricted casino gambling throughout the state was causing social harm, in a gaming context indistinguishable in betting and play from casino slot machines. Further, these two systems offered little in the way of facilitating further engagement with the consumer or aiding the marketing of additional products and services.

Consequently, it would be desirable to provide a lottery gaming system which addresses the above-referenced problems and limitations.

SUMMARY OF THE INVENTION

Accordingly, the present invention is directed to a poker lottery game which builds upon elements of lottery play rather than a simple repackaging of casino poker play and leverages commonly known gaming rules, introducing multiple phases of game play.

The poker lottery game of the present invention includes a poker lottery ticket and multiple levels of game play, which may include an instant win game play level, a drawing game play level, a best hand game play level, and a tournament game play level. The poker lottery ticket includes one or more lottery numbers along with card values which correspond to the lottery numbers. The instant win game play level may comprise an instant win value corresponding to the card values scored according to the rules of a poker game or a derivation thereof. The drawing game play level may comprise a drawing corresponding to the lottery numbers. The best hand game play level may correspond to a prize for the best hand in a region based on the card values scored according to the rules of a poker game or a derivation thereof. The tournament game play level may correspond to an interactive poker tournament. Opening play in the interactive poker tournament may be based upon the card values of the poker lottery ticket or points from a web loyalty rewards program or a loyalty rewards program.

The poker lottery ticket may be purchased or awarded to a customer as part of a web loyalty program or a loyalty rewards program. The poker lottery ticket may be generated by a terminal at a POS (point of sale) location and assigned to an account number. The poker lottery ticket may be generated with one or more levels of play fully or partially disabled. The full or partially disabled game play levels may be fully or partially enabled by registering the poker lottery ticket, as part of a loyalty rewards program, as part of a web loyalty program, by purchase, by fully or partially disabling one or more enabled game play levels, or by combining the poker lottery ticket with one or more other poker lottery tickets. The play value or potential jackpot for a game play level may be increased by registering the poker lottery ticket, as part of a loyalty rewards program, as part of a web loyalty program, by purchase, by fully or partially disabling one or more enabled game play levels, or by combining the poker lottery ticket with one or more other poker lottery tickets. The multiple levels of game play associated with the poker lottery ticket may be associated with separate sections of the poker lottery ticket and may be severable. The poker lottery ticket may be generated with one or more of, or portions of, or the entirety of, the lottery numbers and/or card values concealed. The concealed lottery numbers and/or card values may be revealed by registering the poker lottery ticket or as part of a loyalty rewards program or by purchase or assigned and revealed as part of tournament play.

The present invention provides a gaming system which is not a mere repackaging of casino gaming but rather builds upon elements of normal lottery play, introducing multi-layered gaming elements as desired extensions. The present invention provides a poker lottery game which builds upon elements of known gaming rules with multiple phases of win potential.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which:

FIG. 3 is a chart illustrating pre-assignment of lottery numbers to card values for a lottery poker game, in accordance with an exemplary embodiment of the present invention;

DETAILED DESCRIPTION OF THE INVENTION

Reference will now be made in detail to exemplary embodiments of the invention, examples of which are illustrated in the accompanying drawings.

New gaming systems must not be a mere repackaging of casino gaming but rather must operate at one level within the normal parameters of lottery gaming, yet extrapolate on lottery play to present multi-layered gaming elements as desirable extensions. New gaming systems should facilitate further engagement with the consumer and aid in the marketing of additional products and services.

Figure 1:
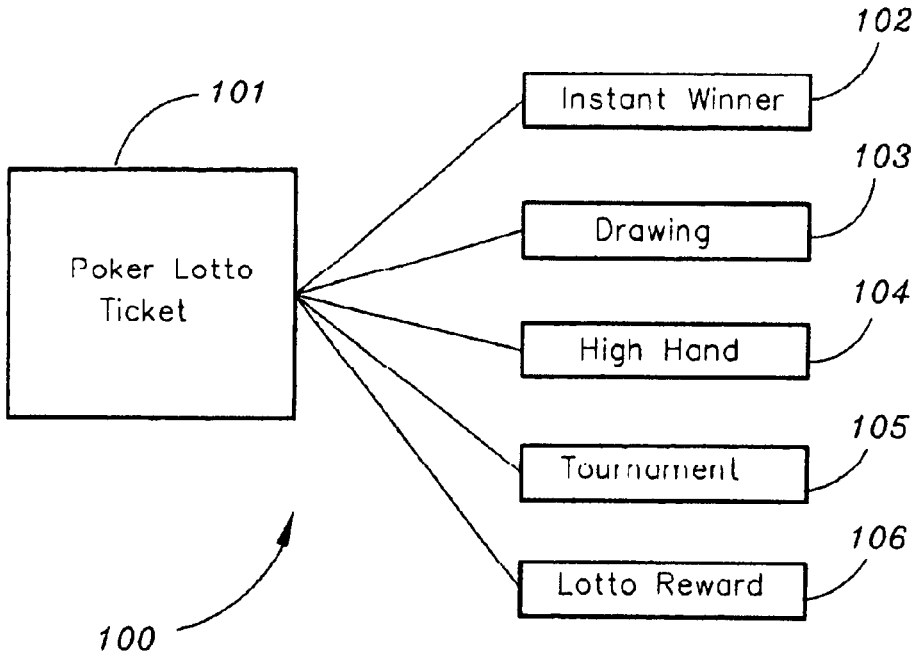
FIG. 1 is a block diagram illustrating a poker lottery game, in accordance with an exemplary embodiment of the present invention.

Referring generally to FIG. 1; a poker lottery game 100, in accordance with an exemplary embodiment of the present invention, in illustrated. The poker lottery game 100 includes a poker lottery ticket 101 and multiple levels of game play, which may include levels of game play 102-106. The poker lottery ticket 101 may comprise a physical ticket or may comprise a virtual ticket. Game play level 102 may be an instant win game play level. Game play level 103 may be a drawing game play level. Game play level 104 may be a best hand game play level. Game play level 105 may be a tournament game play level. Game play level 106 may be a lottery reward game play level.

A poker lottery ticket 200 which may be utilized in the poker lottery game 100, in accordance with an exemplary embodiment of the present invention, is illustrated. The poker lottery ticket 200 will be described in the context of a 5 card stud poker lottery game but the poker lottery game 100 may comprise poker variants (or derivations thereof) other than 5 card stud without departing from the scope of the present invention, such as draw poker (such as 5 card draw), stud poker, or community poker (such as Texas Hold 'Em or Omaha Hold 'Em). A derivation of a poker variant is game based upon a poker variant (including, but not limited to, a high card game based upon 5 card stud). The poker lottery ticket 200 includes several elements that convey gaming information. The poker lottery ticket 200 includes one or more lottery numbers 201 along with card values 202 which correspond to the lottery numbers 201.

The lottery numbers 201 may include one or more numbers which do not have corresponding card values 202. For example, the lottery numbers 201 may be comprised of six separate numbers, only five of which have corresponding card values 202. The sixth number may comprise a bonus number which does not have corresponding card values 202.

The poker lottery ticket 101 for the poker lottery game 100 may be purchased. Alternatively, the poker lottery ticket 101 for the poker lottery game 100 may be awarded to a customer as part of a loyalty rewards program. For example, a poker lottery ticket 101 may print out at the checkout or gas pump for a grocery store or gas station customer as a loyalty reward for shopping at the grocery store or gas station. Alternatively, a poker lottery ticket 101 may be emailed to a credit card customer as a loyalty reward for utilizing a credit card.

The poker lottery ticket 101 may be generated as part of a web loyalty rewards program. For example, a web site or ad on the Internet may be operable to record when the web site or ad has been viewed by an account which has been registered. The web site or ad may detect that an account viewed the web site or ad by reading a cookie stored on the device utilized by the account to access the web site or ad (including but not limited to a digital computer, a personal digital assistant, and a cell phone) or stored on a permanent or removable media connected to the device (including, but not limited to, a Universal Serial Bus (USB) drive, a flash memory drive, a smart drive, and a cell phone memory device. After the views have been recorded to the account, the account holder may access a poker lottery web site to claim the poker lottery ticket.

Figure 11:
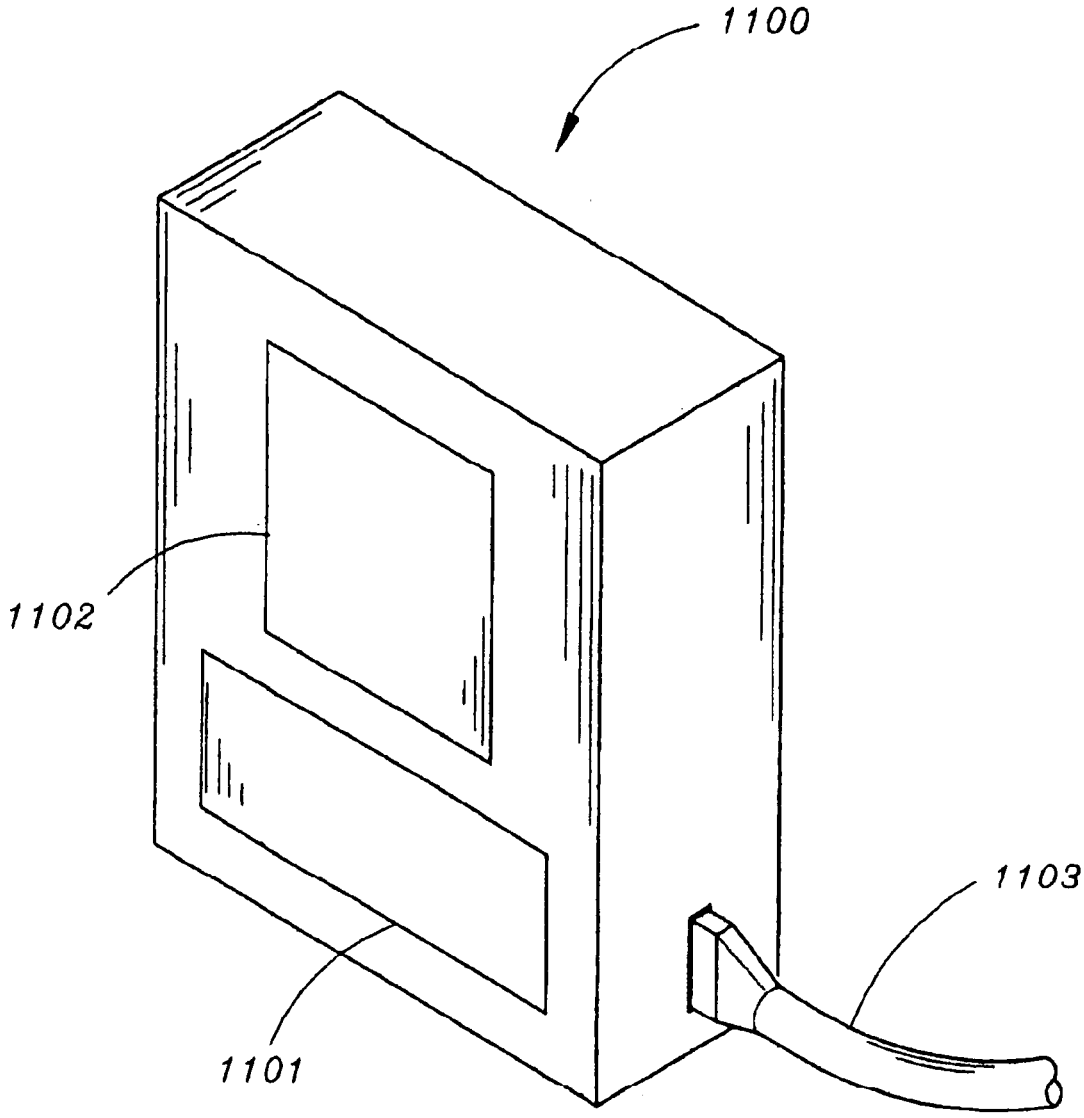
FIG. 11 is an isometric view of a terminal for use in providing a poker lottery game, in accordance with an exemplary embodiment of the present invention.

The poker lottery ticket 101 may be generated by a poker lottery terminal at a point of sale (POS) location such as the terminal 1100 illustrated in FIG. 11. The poker lottery ticket 101 may be generated as a loyalty reward based upon a sale at the POS location. A POS location may include, but is not limited to, a store counter and a gas pump. The poker lottery terminal may be separate from the POS location and the pay devices (such as a credit card reader or check reader) which are typically integrated into a POS location. The terminal 1100 includes an input area 1101, an output area 1102, and a network connection 1103. The input area 1101 may comprise one or more various input devices including, but not limited to, a RFID (radio-frequency identification) reader, a near field communication device, a keypad, a bar code reader, a numeric pad, a touch screen, a magnetic stripe reader, a biometric (including, but not limited to, fingerprint) reader, a microphone, and a MICR (magnetic ink character recognition) reader. The output area 1102 may comprise one or more various output devices including, but not limited to a printer, a video display (including but not limited to a CRT (cathode ray tube) display, a cash dispenser, and a LCD (liquid crystal display) display), an alphanumeric display (including but not limited to a CRT (cathode ray tube) display, and a LCD (liquid crystal display) display), and a speaker. The input area 1101 and the output area 1102 may comprise the same area, such as when a touch screen is utilized to display and receive information. The network connection 1103 may comprise any wired or wireless network connection (including, but not limited to, an Ethernet connection and a serial connection) which may be operable to connect the terminal 1100 to a kiosk associated with the POS location or a central database. The poker lottery terminal may print the poker lottery ticket 101. The poker lottery terminal may be operable to display the poker lottery ticket 101 via output area 1102.

The poker lottery terminal may be operable to assign a poker lottery ticket 101 to an account. The poker lottery terminal may determine an account to assign the poker lottery ticket 101 to based on information received through the input area 1101. For example, account information may be read from a poker lottery account card, a driver's license, or cell phone via a RFID reader, a near field communication device, or a magnetic stripe reader. Alternatively, an account number or account identifier (including, but not limited to, a phone number) may be entered via a keypad, a numeric pad, a microphone, or a touch screen. Alternatively, a biometric could be scanned and associated with an account.

The poker lottery terminal may be operable to alter the poker lottery ticket 101. If purchase is required to alter the poker lottery ticket 101, financial information associated with the account may be utilized to enable the purchase (including, but not limited to credit card account processing or ACH (automated clearing house) transfer).

Prior to a terminal being operable to assign a poker lottery ticket 101 to an account, an account may have to be enrolled. An account may be enrolled at an enrollment terminal such as the terminal illustrated in FIG. 11. A kiosk may function as an enrollment terminal. Alternatively, an account may be enrolled on a poker lottery web site. The terminal 1100 includes an input area 1101, an output area 1102, and a network connection 1103. The input area 1101 may comprise one or more various input devices including, but not limited to, a RFID (radio-frequency identification) reader, a near field communication device, a keypad, a numeric pad, a touch screen, a bar code reader, a magnetic stripe reader, a biometric (including, but not limited to, fingerprint) reader, a microphone, and a MICR (magnetic ink character recognition) reader. The output area 1102 may comprise one or more various output devices including, but not limited to a printer, a video display (including but not limited to a CRT (cathode ray tube) display, and a LCD (liquid crystal display) display), an alphanumeric display (including but not limited to a CRT (cathode ray tube) display, and a LCD (liquid crystal display) display), and a speaker. The input area 1101 and the output area 1102 may comprise the same area, such as when a touch screen is utilized to display and receive information. The network connection 1103 may comprise any wired or wireless network connection (including, but not limited to, an Ethernet connection and a serial connection) which may be operable to connect the terminal 1100 to a kiosk or a central database.

An account may be enrolled at an enrollment terminal. Personal and financial information (including, but not limited to, bank or credit card account information, name, age, biometric information, and address information) may be entered during enrollment via a magnetic stripe reader, RFID reader, near field communication device, MICR reader, keypad, numeric pad, microphone, biometric reader, or touch screen. Age may be verified for compliance with local laws prior to the enrollment of the account. Account information may be associated with an account card, a driver's license, biometric, account number, pin, or cell phone as part of enrollment.

A poker lottery ticket 101 generated at a poker lottery terminal may need to be registered. If the poker lottery ticket 101 is not registered within an expiration period all game play levels associated with the poker lottery ticket 101 may be disabled. The poker lottery ticket 101 may be registered at a web site, a point of sale location, or at a kiosk. The kiosk may comprise a kiosk terminal such as the terminal illustrated in FIG. 11. The terminal 1100 includes an input area 1101, an output area 1102, and a network connection 1103. The input area 1101 may comprise one or more various input devices including, but not limited to, a RFID (radio-frequency identification) reader, a near field communication device, a keypad, a numeric pad, a touch screen, a bar code reader, a magnetic stripe reader, a biometric (including, but not limited to, fingerprint) reader, a microphone, and a MICR (magnetic ink character recognition) reader. The output area 1102 may comprise one or more various output devices including, but not limited to a printer, a video display (including but not limited to a CRT (cathode ray tube) display, and a LCD (liquid crystal display) display), an alphanumeric display (including but not limited to a CRT (cathode ray tube) display, a cash dispenser, and a LCD (liquid crystal display) display), and a speaker. The input area 1101 and the output area 1102 may comprise the same area, such as when a touch screen is utilized to display and receive information. The network connection 1103 may comprise any wired or wireless network connection (including, but not limited to, an Ethernet connection and a serial connection) which may be operable to connect the terminal 1100 to a poker lottery terminal or a central database.

The kiosk terminal may be operable to receive account information from a poker lottery account card, a driver's license, or cell phone via a RFID reader, a near field communication device, or a magnetic stripe reader. Alternatively, an account number may be entered via a keypad, a numeric pad, a microphone, or a touch screen. Alternatively, a biometric could be scanned and associated with an account. The kiosk terminal may be operable to receive information related to a poker lottery ticket 101 via a bar code scanner or a code entered into a keypad or a numeric pad. The kiosk may be operable to display information related to a poker lottery ticket 101 via the output area 1102. The kiosk terminal may be operable to assign a poker lottery ticket 101 to an account. The kiosk terminal may be operable to register a poker lottery ticket 101 which has been assigned to an account. The kiosk terminal may be operable as an enrollment terminal. The kiosk terminal may be operable as a poker lottery terminal. The kiosk terminal may be operable to alter the poker lottery ticket 101. If purchase is required to alter the poker lottery ticket 101, financial information associated with the account may be utilized to enable the purchase (including, but not limited to credit card account processing or ACH (automated clearing house) transfer).

Referring again to FIG. 1, the poker lottery ticket 101 for the poker lottery game 100 may be generated with one or more levels of play fully or partially disabled. For example, the poker lottery ticket 101 may be purchased or awarded with game play levels 102-104 enabled but with game play level 105 disabled. The disabled game play levels of the lottery poker ticket 101 may be enabled by registering the poker lottery ticket 101. The lottery poker ticket 101 may be registered utilizing including, but not limited to, a kiosk, a web site, a text message, and a telephone. Alternatively, the disabled game play levels of the lottery poker ticket 101 may be enabled as part of a loyalty rewards program or by purchase. Alternatively, a disabled game play level may be enabled by disabling one or more enabled game play levels. For example, the poker lottery ticket 101 may be purchased or awarded with game play levels 102-104 enabled but with game play level 105 disabled and game play level 105 may be enabled by disabling game play levels 102 and 104. By way of further example, the poker lottery ticket 101 may be purchased or awarded with game play level 102 partially enabled and game play level 106 disabled and game play level 106 may be enabled by disabling the partially enabled game play level 101. Alternatively, a disabled game play level may be enabled by aggregating or combining one or more poker lottery tickets 101 together. For example, multiple poker lottery tickets 101 may be aggregated or combined together to enable a disabled game play level 105 for a single poker lottery ticket 101. By way of further example, multiple poker lottery tickets 101 all with game play level 102 partially enabled may be aggregated or combined to fully enable game play level 102 for a single poker lottery ticket 101.

Figure 2:
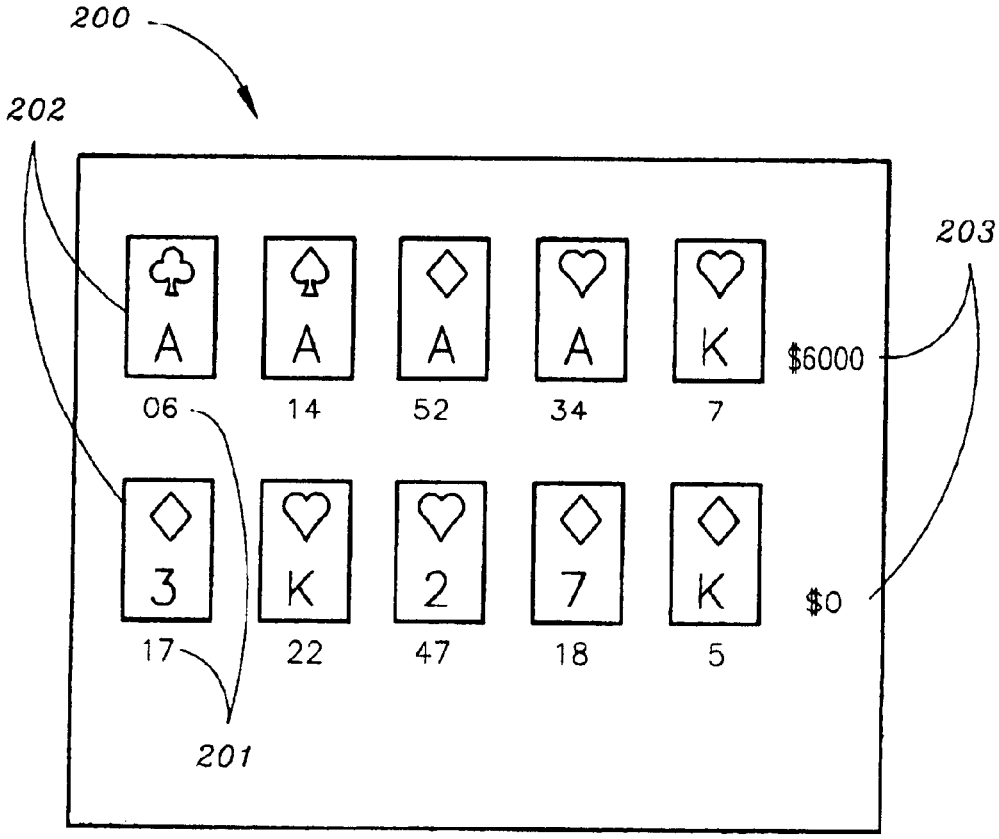
FIG. 2 is a diagram illustrating a poker lottery ticket for use in a poker lottery game, in accordance with an exemplary embodiment of the present invention.

Additionally, multiple poker lottery tickets 101 may be aggregated or combined together to increase the play value of a game play level. For example, referring again to FIG. 2, multiple poker lottery tickets 200 may be aggregated or combined together to increase the instant win value 203 of a single poker lottery ticket 200.

Referring again to FIG. 1, the multiple levels of game play associated with the poker lottery ticket 101 may be severable. For example, if the poker lottery ticket 101 is a paper printed ticket the poker lottery ticket 101 may comprise several sections separated by perforations which can be torn apart. The multiple levels of game play may be associated with the separate sections of the poker lottery ticket 101. For example, game play level 102 and game play level 105 may be associated with different sections of the poker lottery ticket 101 and may be detached from each other and utilized, sold, or distributed separately.

The poker lottery ticket 200 may be generated with one or more of, or portions of, or all of, the lottery numbers 201 and/or card values 202 concealed. The concealed lottery numbers 201 and/or card values 202 may be revealed by registering the poker lottery ticket 101. The lottery poker ticket 101 may be registered utilizing including, but not limited to, a kiosk, a web site, a text message, and a telephone. Alternatively, the concealed lottery numbers 201 and/or card values 202 may be revealed as part of a loyalty rewards program or by purchase. Alternatively, the concealed lottery numbers 201 and/or card values 202 may be revealed by aggregating or combining one or more poker lottery tickets 101 together. For example, multiple poker lottery tickets 200 may be aggregated or combined together to reveal concealed lottery numbers 201 and/or card values 202 for a single poker lottery ticket 101.

The lottery numbers 201 for the poker lottery ticket 200 may be randomly generated. Referring to FIG. 3, the card values 202 which correspond to the lottery numbers 201 may be pre-assigned, such as pre-assigning the number 1 to correspond to the ace of clubs and pre-assigning the number 52 to the king of spades. Alternatively, the lottery numbers 201 for the poker lottery ticket 200 may be selected and card values 202 may be randomly assigned to the lottery numbers 201. Alternatively, for tickets to be used for tournament play, the lottery numbers 201 may be assigned based upon the cards dealt during the tournament which would use FIG. 3 number 300 in reverse order to assign lottery Ball (Number) from the Card (i.e. Ace of Spades=1). As shown in FIG. 3, card values 202 may correspond to values of playing cards of a deck of cards in which the deck of cards may include fifty-two card values and a plurality of joker card values.

Referring again to FIG. 2, the poker lottery ticket 200 may include an instant win value 203 based upon the card values 202 in correspondence with a first level of play 102 for the poker lottery game 100. The instant win value 203 may be calculated based upon the card values 202 in accordance with 5 card stud poker rules. For example, as illustrated, card values 202 of four aces and a king may have an instant win value of $6000. The instant win value 203 may be alterable by trading the card values 202 or a portion of the card values 202 for new card values 202 or a new portion of the card values 202 (similar to discarding and receiving new cards in a poker game).

The lottery numbers 201 may correspond to a second level of play 103 for the poker lottery game 100. The second level of play 103 may be a lottery drawing (such as a traditional lottery) where drawing numbers are generated and the poker lottery ticket 101 which includes the lottery numbers 201 that match the drawing numbers win. The date of the lottery drawing may not be fixed until registration of the poker lottery ticket 101.

Figure 4:
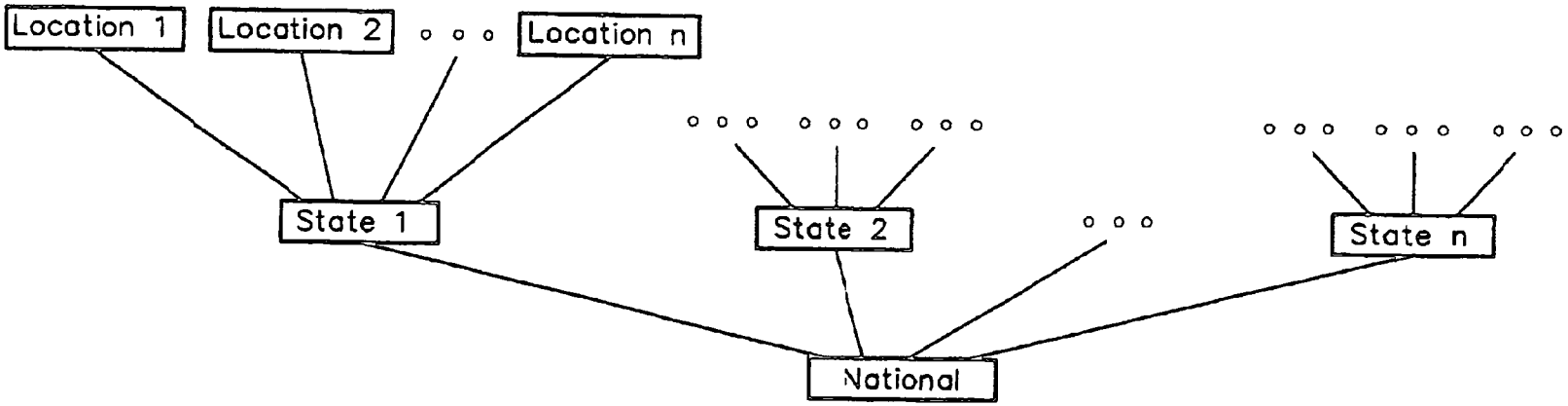
FIG. 4 is a block diagram illustrating multiple tiers of regions for a best hand competition for a poker lottery game, in accordance with an exemplary embodiment of the present invention.

The card values 202 may also correspond to a third level of play 104 for the poker lottery game 100 wherein the best hand (evaluated according to 5 card stud poker rules) in a region wins. The region may comprise a local, statewide, multi-state, nationwide, international, supranational, or other region. As illustrated in FIG. 4, the region may comprise multiple tiers of regions. For example, the best hand in a local region may win and then may be evaluated against the winners of the other local regions within a state. If the card values 202 have been altered by trading the card values 202 or a portion of the card values 202 for new card values 202 or a new portion of the card values 202 (similar to discarding and receiving new cards in a poker game) the best hand evaluation may be based on the original card values 202 or the altered card values 202. The date of the best hand competition may not be fixed until registration of the poker lottery ticket 101.

The poker lottery game 100 may include a fourth level of play 105 wherein the poker lottery ticket 101 enables participation in an interactive poker tournament. The poker lottery ticket 101 may enable participation in an interactive poker tournament by including a claim number or login information which may be utilized to access the interactive poker tournament. Alternatively, the poker lottery ticket 101 may enable participation in an interactive poker tournament by serving as a pass for access to the interactive poker tournament.

The interactive poker tournament may comprise the same variety of poker as variety of poker or derivation thereof which the card values 202 of the poker lottery ticket 101 are evaluated under. Alternatively, the interactive poker tournament may comprise a different variety of poker from the variety of poker which the card values 202 of the poker lottery ticket 101 are evaluated under. For example, the card values 202 of the poker lottery ticket 101 may be evaluated according to 5 card stud whereas the interactive poker tournament comprises Texas Hold 'Em. Participation in the interactive poker tournament may include, but is not limited to, online, telephone, text message, and in person participation.

The poker lottery ticket 101 may enable participation in an interactive poker tournament which occurs at a fixed time. The fixed time for the occurrence of the interactive poker tournament may not be fixed until registration of the poker lottery ticket 101. Alternatively, the poker lottery ticket 101 may enable participation in an interactive poker tournament which can be accessed at any time.

Figure 5:
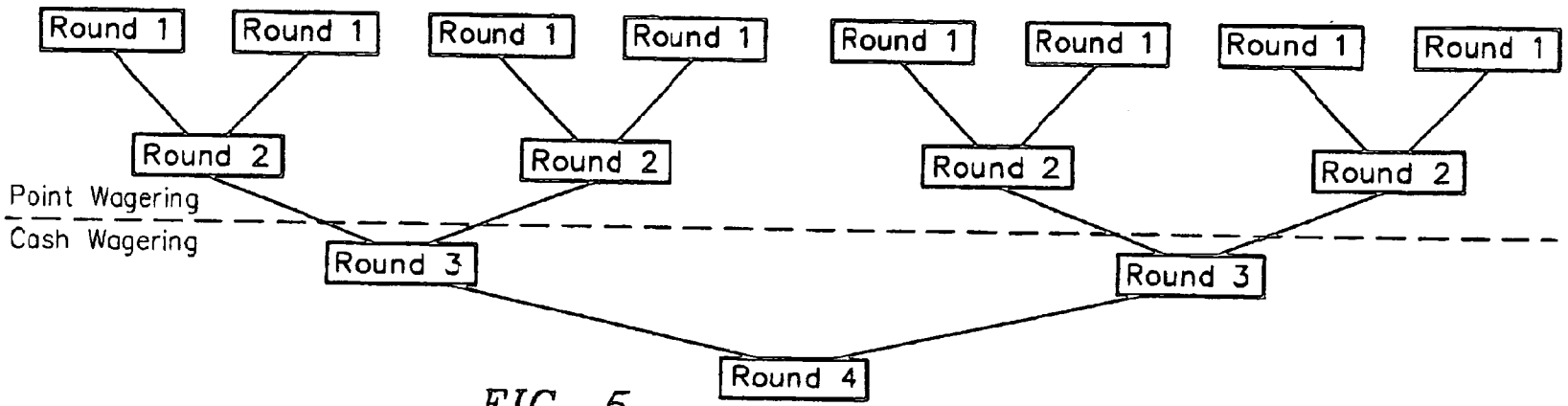
FIG. 5 is block diagram illustrating multiple elimination rounds of an interactive poker tournament for a poker lottery game, in accordance with an exemplary embodiment of the present invention.

As illustrated in FIG. 5, the interactive poker tournament may include multiple rounds of elimination play wherein the winners from a round progress to the next level of elimination, ending in a final winner. Each round may include a single poker hand (wherein the winner of the hand is the winner of the round) or may include multiple poker hands (wherein the winner of the most hands in the round or whoever remains in play throughout the round and ends the round with the most points or cash is the winner of the round). The winner of the tournament may be whoever remains in play throughout the tournament and ends the tournament with the most points or cash. Additional poker lottery tickets 101 may be purchased, awarded, or claimed during the tournament and aggregated or combined with the poker lottery ticket 101 which enabled participation in the interactive poker tournament in order to further game play (such as where a player has run out of points or cash required for further tournament play). A poker lottery ticket 101 purchased, awarded, or claimed during the tournament may be based on the players current hand and/or the current community cards. As illustrated in FIG. 5, the multiple rounds of elimination play may include a first point wagering phase followed by a cash wagering phase. During the point wagering phase players may wager and win points. At the end of the point wagering phase the winners of the round in the point wagering phase may win cash and proceed on to the cash wagering phase. During the cash wagering phase players may wager and win cash. During either the point wagering or cash wagering phase a player may be able to withdrawn from the interactive tournament, keeping the points or cash won to that point. Upon withdrawal from the interactive poker tournament the player may be able to exchange the points or cash for prizes (such as apparel or gifts) or new poker lottery tickets.

Opening play in the interactive poker tournament may be based upon the card values 202 of the poker lottery ticket 200. The amount that a player has available to wager in opening play in the interactive poker tournament may be based upon the card values 202 of the poker lottery ticket 200. For example, a player may start the opening play of the interactive poker tournament with 500 points because the card values 202 of the poker lottery ticket 200 included four aces and the king of hearts. The amount that a player has available to wager in opening play in the interactive poker tournament may be based on or increased by a loyalty rewards program award. For example, a player may begin the interactive poker tournament with 500 extra points as a reward for shopping regularly at a gas station. Alternatively, all players in the interactive poker tournament may begin opening play equally regardless of the card values 202 of the poker lottery ticket 200.

The interactive poker tournament will be described with regards to an online Texas Hold 'Em interactive poker tournament. However, the interactive poker tournament may comprise a poker variant other than Texas Hold 'Em and participation in the tournament may be by means other than online access (including but not limited to telephone or in person) without departing from the scope of the present invention.

Figure 6:
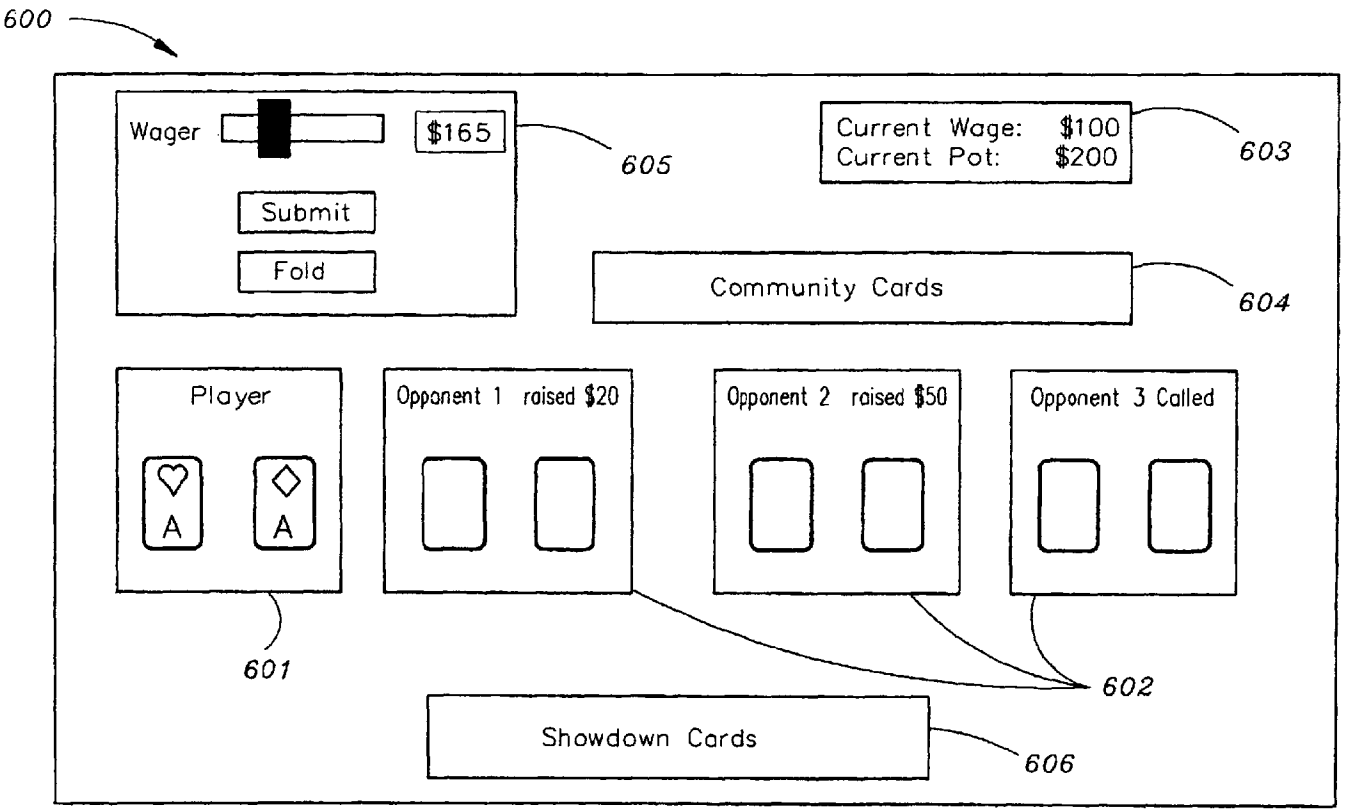
FIG. 6 is a diagram illustrating a sample play screen for an online Texas Hold 'Em interactive poker tournament for a poker lottery game, in accordance with an exemplary embodiment of the present invention.

Referring now to FIG. 6, a sample play screen 600 for an online Texas Hold 'Em interactive tournament is illustrated. The sample play screen 600 is illustrated utilizing cash wagering. However, other types of wagering may be utilized with the sample play screen 600 without departing from the scope of the invention. This sample play screen 600 is intended to be merely exemplary and is not intended to be limiting. The sample play screen 600 may include a player area 601 where the cards dealt to the player are displayed. The sample play screen 600 may include one or more opponent areas 602. The opponent areas 602 may include an indicator indicating the most recent action taken by that opponent (such as raised $20, called, or folded). The opponent area 602 may display the opponent's cards (though prior to a showdown the opponent's cards may be shown as blank cards). The sample play screen 600 may include a game status area 603 which includes indicators indicating the player's current wager and the current pot. The sample play screen 600 may include a community card area 604 where community cards are displayed. The sample play screen 600 may include a wager area where the player may adjust and submit their wager or fold. The sample play screen 600 may include a player showdown area 606 where the player may drag cards to in order to form a hand during a showdown.

The play of a sample hand utilizing the sample play screen 600 for an online Texas Hold 'Em interactive tournament will now be described. This play of a sample hand is intended to be merely exemplary and is not intended to be limiting. Each player may be dealt two cards. These two cards may only be visible to the player to which they have been dealt. A pre-flop betting round may then occur. A betting round may continue until the player and the one or more opponents have folded, wagered the full amount available to wager, or matched the other wagers. After the pre-flop betting round, assuming at least the player and at least one opponent or at least two opponents remain, three community cards (a flop) may be dealt. The flop may followed by a flop betting round. After the flop betting round an additional community card may be dealt followed by a third betting round. After the third betting round a final community card may dealt followed by a fourth betting round. If necessary, the fourth betting round may be followed by a showdown. During the showdown the player may drag cards from the community card area 604 or the player area to the showdown area 607 to form a hand. The winner of the hand may be the player or opponent with the best hand. An opponent's hand in a showdown may be displayed in the opponent areas 602. At the end of the hand the winning hand may be displayed in the showdown area 606 and may include an indicator indicating whether the player or an opponent won.

Referring again to FIG. 1, the poker lottery game 100 may include a fifth level of play 106 wherein the poker lottery ticket 101 may be redeemed for gifts (including, but not limited to, gift cards, discount coupons, household appliances, gas, clothing, food, drink, and movie tickets). The poker lottery ticket 101 may be aggregated or combined with one or more additional poker lottery tickets 101 to increase the gift value the poker lottery ticket 101 may be redeemed for. The poker lottery ticket 101 may be redeemable for gifts at the same location where the poker lottery ticket 101 was generated.

Figure 7:
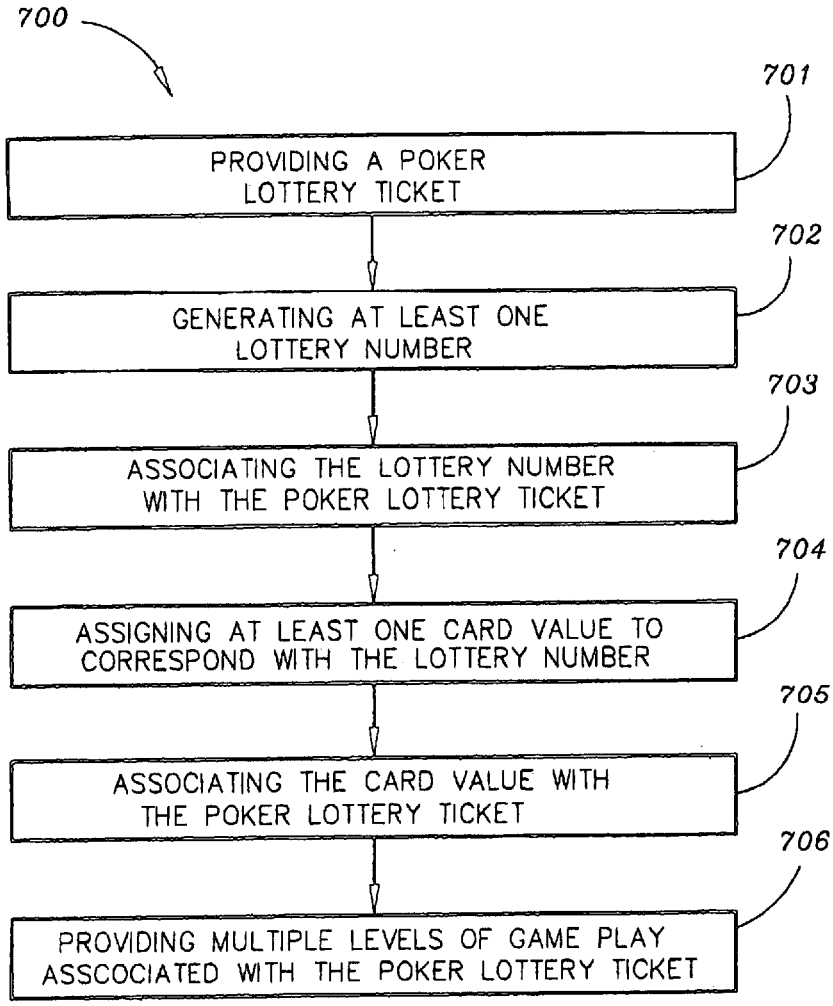
FIG. 7 is a flow chart illustrating a method of providing a poker lottery game, in accordance with an exemplary embodiment of the present invention.

Referring now to FIG. 7 a method 700 of providing a poker lottery game, in accordance with an exemplary embodiment of the present invention, is shown. In step 701, a poker lottery ticket is provided. In step 702, at least one lottery number is generated. In step 703, the lottery number is associated with the poker lottery ticket. In step 704, at least one card value is assigned to correspond with the lottery number. In step 705, the card value is associated with the poker lottery ticket. In step 706, multiple levels of game play are provided associated with the poker lottery ticket. The multiple levels of game play may comprise an instant win game play level, a drawing game play level, a best hand game play level, and an interactive tournament game play level.

Figure 8:
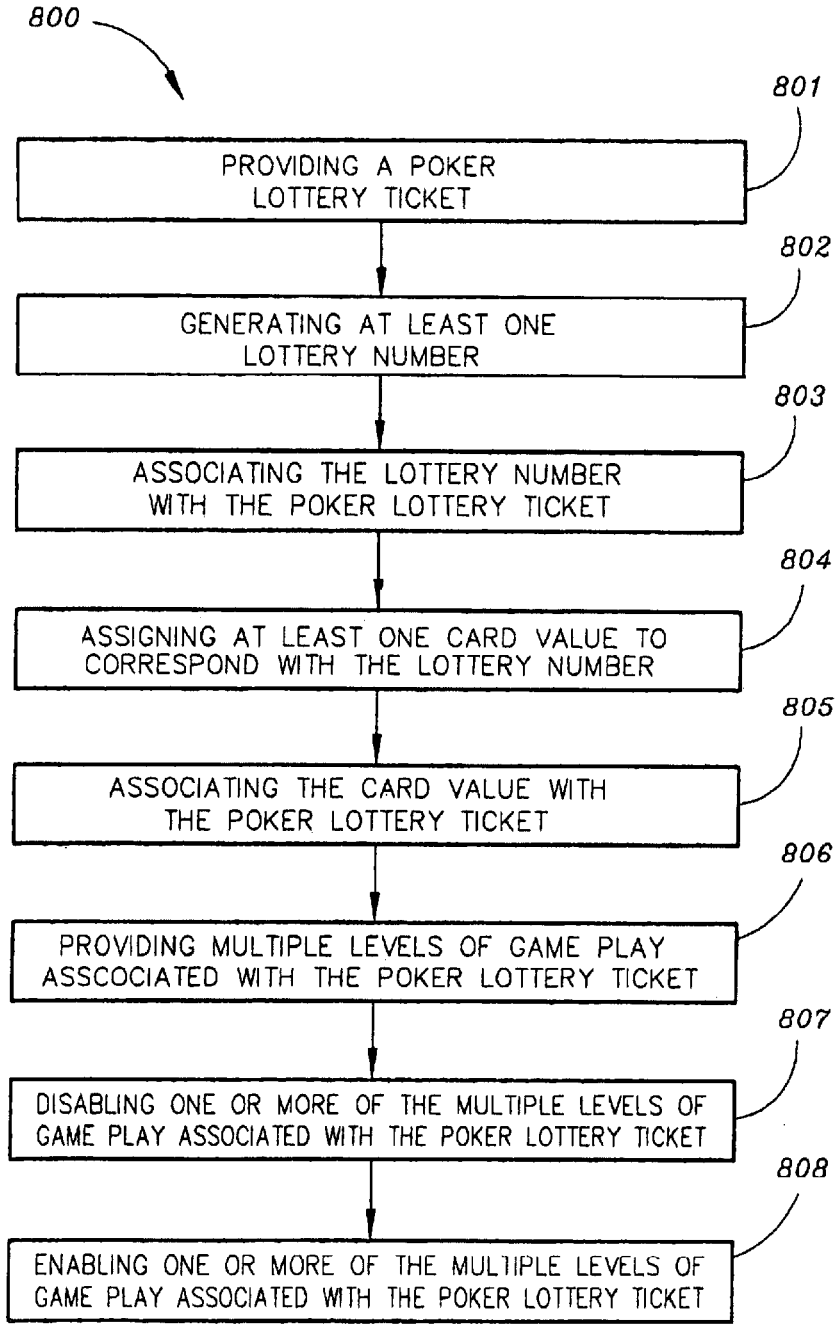
FIG. 8 is a flow chart illustrating a method of providing a poker lottery game, in accordance with an alternative embodiment of the present invention.

Referring now to FIG. 8 a method 800 of providing a poker lottery game, in accordance with an exemplary embodiment of the present invention, is shown. In step 801, a poker lottery ticket is provided. In step 802, at least one lottery number is generated. In step 803, the lottery number is associated with the poker lottery ticket. In step 804, at least one card value is assigned to correspond with the lottery number. In step 805, the card value is associated with the poker lottery ticket. In step 806, multiple levels of game play are provided associated with the poker lottery ticket. The multiple levels of game play may comprise an instant win game play level, a drawing game play level, a best hand game play level, and an interactive tournament game play level. In step 807, one or more of the multiple levels of game play associated with the poker lottery ticket are disabled. In step 808, one or more of the multiple levels of game play associated with the poker lottery ticket are enabled.

Figure 9:
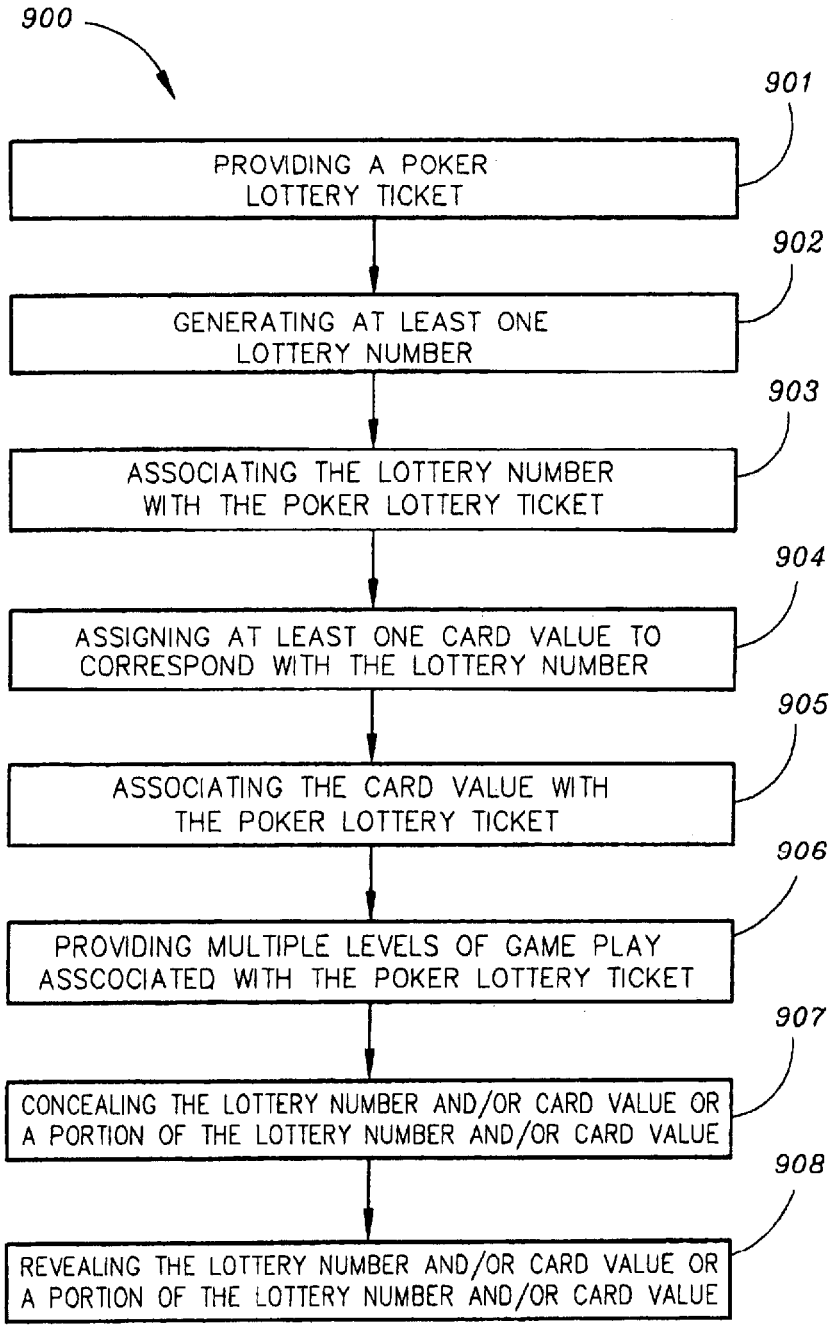
FIG. 9 is a flow chart illustrating a method of providing a poker lottery game, in accordance with an alternative embodiment of the present invention.

Referring now to FIG. 9 a method 900 of providing a poker lottery game, in accordance with an exemplary embodiment of the present invention, is shown. In step 901, a poker lottery ticket is provided. In step 902, at least one lottery number is generated. In step 903, the lottery number is associated with the poker lottery ticket. In step 904, at least one card value is assigned to correspond with the lottery number. In step 905, the card value is associated with the poker lottery ticket. In step 906, multiple levels of game play are provided associated with the poker lottery ticket. The multiple levels of game play may comprise an instant win game play level, a drawing game play level, a best hand game play level, and an interactive tournament game play level. In step 907, the lottery number and/or card value or a portion of the lottery number and/or card value is concealed. In step 908, the lottery number and/or card value or a portion of the lottery number and/or card value is revealed.

Figure 10:
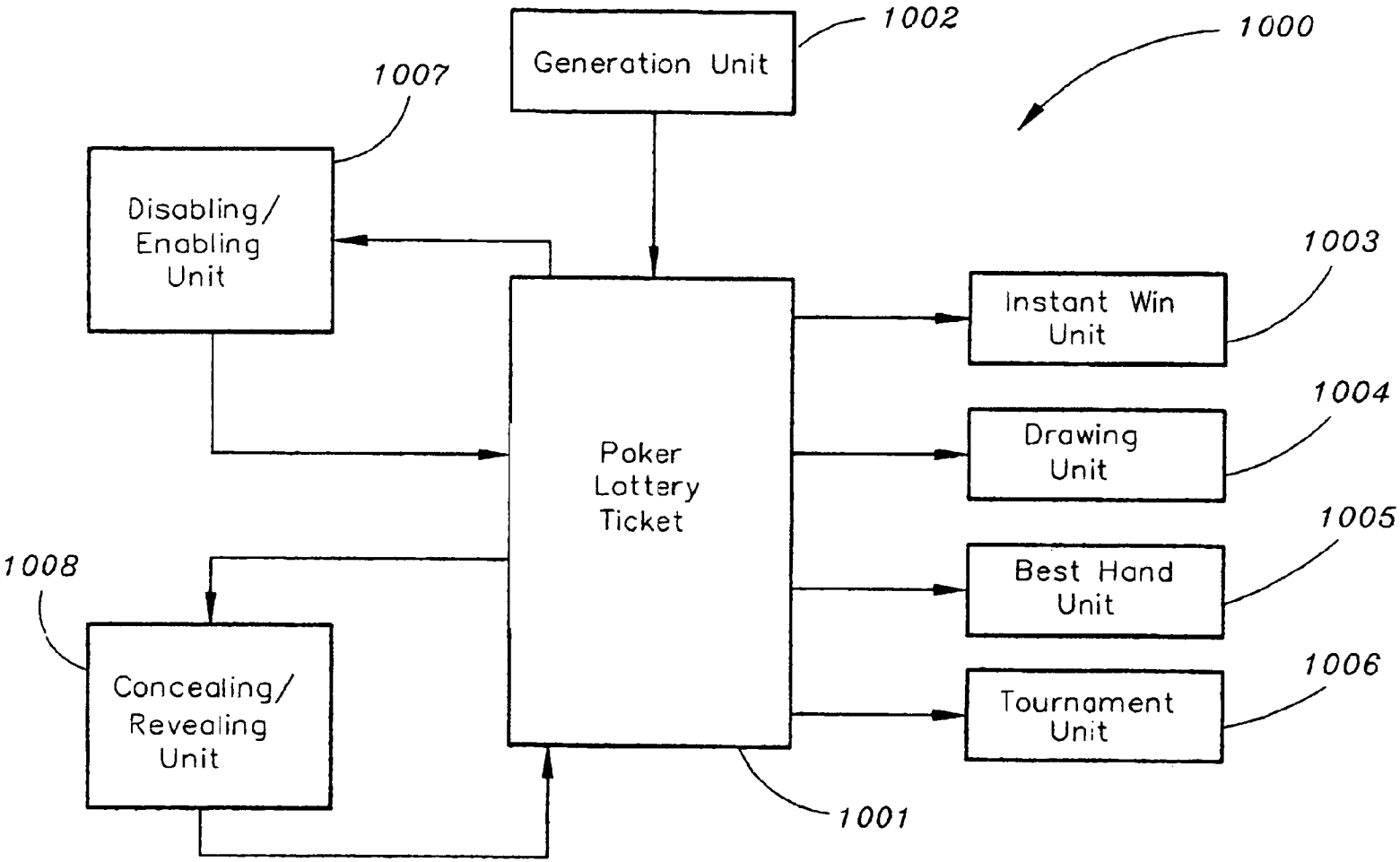
FIG. 10 is a block diagram of a system for playing lottery poker, in accordance with an alternative embodiment of the present invention.

Referring now to FIG. 10, a system for playing lottery poker 1000 is illustrated. The system 1000 comprises a poker lottery ticket 1001, a generation unit 1002, an instant win unit 1003, a drawing unit 1004, a best hand unit 1005, a tournament unit 1006, a disabling/enabling unit 1007, and a concealing revealing unit 1008. The poker lottery ticket 1001 includes a lottery number and a card value associated with the lottery number. The poker lottery generation unit 1002 generates the poker lottery ticket 1001. The poker lottery ticket 1001 is utilizable with the instant win unit 1003 to provide an instant win game play level. The poker lottery ticket 1001 is utilizable with the drawing unit 1004 to provide a drawing game play level. The poker lottery ticket 1001 is utilizable with the best hand unit 1005 to provide an best hand game play level. The poker lottery ticket 1001 is utilizable with the tournament unit 1006 to provide a tournament game play level. For tournament play the generation unit 1002 may interact with the Tournament unit 1006 to generate the lottery ticket numbers based upon cards randomly generated and dealt to the ticket holder or comprising the community cards with some numbers possibly being randomly generated. The disabling/enabling unit 1007 is operable to disable utilization of the poker lottery ticket with units 1002-1006. The disabling/enabling unit 1007 is operable to enable disabled utilization of the poker lottery ticket 1001 with units 1002-1006. The concealing/revealing unit 1008 is operable to conceal the lottery number, the card value, a portion of the lottery number, and/or a portion of the card value. The concealing/revealing unit 1008 is operable to reveal the concealed lottery number, card value, portion of the lottery number, and/or portion of the card value.

The present invention provides a gaming system which is not a mere repackaging of casino gaming but rather builds upon elements of normal lottery play, introducing multi-layered gaming elements as desired extensions. The present invention provides a poker lottery game based on known gaming rules with multiple phases of win potential.

It is understood that the specific order or hierarchy of steps in the processes disclosed is an example of exemplary approaches. Based upon design preferences, it is understood that the specific order or hierarchy of steps in the processes may be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A system for playing lottery poker, comprising:

a ticket, which includes at least one lottery number and at least one playing card value associated with the lottery number;

a ticket generation unit, which generates the ticket;

a first game play level unit; and at least one additional game play level unit;

wherein the ticket is utilizable with the first game play level unit to provide a first game play level, the ticket is utilizable with the at least one additional game play level unit to provide at least one additional game play level, and at least one level of game play relates to one selected from a variety of poker and a derivation of a variety of poker, wherein one selected from the first game play level and the at least one additional game play level include altering the playing card value, wherein the ticket is redeemable for a gift based upon a result of said first game play level and said at least one additional game play level.

2. The system of claim 1, wherein the variety of poker comprises one selected from stud poker, draw poker, and community poker.

3. The system of claim 1, wherein the first game play level and the at least one additional game play level are selected from an instant win game play level, a drawing game play level, a best hand game play level, a tournament game play level, and a lottery reward game play level.

4. The system of claim 1, wherein the ticket generation unit generates the ticket as part of one selected from a sale, a web rewards loyalty program, and a loyalty rewards program.

5. The system of claim 4, wherein the web loyalty rewards program includes a web site with a credit value and wherein a credit is generated toward generation of a ticket for performing one selected from viewing a web page, viewing a web ad, and making a purchase through the web site.

6. The system of claim 1, wherein the ticket generation unit generates the lottery number randomly and assigns the playing card value according to a table of playing card values.

7. The system of claim 1, wherein the ticket generation unit generates the lottery number manually and assigns the playing card value to the lottery number randomly.

8. The system of claim 1, wherein the ticket generation unit generates the lottery number based upon the playing card value.

9. The system of claim 1, wherein the ticket generation unit generates the playing card value based upon the lottery number.

10. The system of claim 1, wherein the utilization of the ticket with the first game play level unit and the at least one additional game play level unit are severable.

11. The system of claim 1, wherein the ticket generation unit includes a terminal at a POS (point of sale) location, the terminal assigns the ticket to an account, and the terminal identifies the account to assign the ticket to via one selected from a RFID (radio-frequency identification) reader, a near field communication device, a keypad, a numeric pad, a touch screen, a bar code reader, a magnetic stripe reader, a biometric reader, and a microphone.

12. A system for playing lottery poker, comprising:

a ticket, which includes at least one lottery number and at least one playing card value associated with the lottery number;

a ticket generation unit, which generates the ticket;

a first game play level unit;

at least one additional game play level unit; and an enabling/disabling unit which is operable to perform one selected from:

disabling the utilization of the ticket with one selected from the first game play level unit and the at least one additional game play level unit and partially disabling the utilization of the ticket with one selected from the first game play level unit and the at least one additional game play level unit; and which is operable to perform one selected from:

enabling the disabled utilization of the ticket with one selected from the first game play level unit and the at least one additional game play level unit and enabling the partially disabled utilization of the ticket with one selected from the first game play level unit and the at least one additional game play level unit, wherein the ticket is utilizable with the first game play level unit to provide a first game play level, the ticket is utilizable with the at least one additional game play level unit to provide at least one additional game play level, and at least one level of game play relates to one selected from a variety of poker and a derivation of a variety of poker, wherein the ticket is redeemable for a gift based upon a result of said first game play level and said at least one additional game play level.

13. The system of claim 12, wherein the enabling/disabling unit enables for registering, purchase, reward as part of a loyalty rewards program, disabling an enabled utilization of the ticket with one selected from the first game play level unit and the at least one additional game play level unit, disabling a partially enabled utilization of the ticket with one selected from the first game play level unit and the at least one additional game play level unit, and combining the ticket with at least one additional ticket.

14. A system for playing lottery poker, comprising:

a ticket, which includes at least one lottery number and at least one playing card value associated with the lottery number;

a ticket generation unit, which generates the ticket;

a first game play level unit; and at least one additional game play level unit;

wherein the ticket is utilizable with the first game play level unit to provide a first game play level, the ticket is utilizable with the at least one additional game play level unit to provide at least one additional game play level, and at least one level of game play relates to one selected from a variety of poker and a derivation of a variety of poker, wherein the ticket is redeemable for a gift based upon a result of said first game play level and said at least one additional game play level, the ticket generation unit increases a play value for at least one level of game play for one selected from registering, purchase, reward as part of a loyalty rewards program, disabling an enabled utilization of the ticket with one selected from the first game play level unit and the at least one additional game play level unit, disabling a partially enabled utilization of the ticket with one selected from the first game play level unit and the at least one additional game play level unit, and combining the ticket with at least one additional ticket.

15. The system of claim 14, wherein the variety of poker comprises one selected from stud poker, draw poker, and community poker.

16. The system of claim 14, wherein the first game play level and the at least one additional game play level are selected from an instant win game play level, a drawing game play level, a best hand game play level, a tournament game play level, and a lottery reward game play level.

17. The system of claim 14, wherein the ticket generation unit generates the ticket as part of one selected from a sale, a web rewards loyalty program, and a loyalty rewards program.

18. The system of claim 17, wherein the web loyalty rewards program includes a web site with a credit value and wherein a credit is generated toward generation of a ticket for performing one selected from viewing a web page, viewing a web ad, and making a purchase through the web site.

19. The system of claim 14, wherein the ticket generation unit generates the lottery number randomly and assigns the playing card value according to a table of playing card values.

20. The system of claim 14, wherein the ticket generation unit generates the lottery number manually and assigns the playing card value to the lottery number randomly.

21. The system of claim 14, wherein the ticket generation unit generates the lottery number based upon the playing card value.

22. The system of claim 14, wherein the ticket generation unit generates the playing card value based upon the lottery number.

23. The system of claim 14, wherein the utilization of the ticket with the first game play level unit and the at least one additional game play level unit are severable.

24. The system of claim 14, wherein the ticket generation unit includes a terminal at a POS (point of sale) location, the terminal assigns the ticket to an account, and the terminal identifies the account to assign the ticket to via one selected from a RFID (radio-frequency identification) reader, a near field communication device, a keypad, a numeric pad, a touch screen, a bar code reader, a magnetic stripe reader, a biometric reader, and a microphone.

* * * * *